US006334377B1

(12) United States Patent
Wu

(10) Patent No.: US 6,334,377 B1
(45) Date of Patent: Jan. 1, 2002

(54) ADJUSTABLE TORQUE WRENCH HAVING A LOCK DEVICE

(76) Inventor: Izu Min Wu, No. 108-24, Chong Chin Road, Bei Tun Chu, Taichung (TW), 406

( * ) Notice: Subject to any disclaimer, the term of this patent is extended or adjusted under 35 U.S.C. 154(b) by 0 days.

(21) Appl. No.: 09/716,562

(22) Filed: Nov. 17, 2000

(51) Int. Cl.[7] ..... B25B 23/143
(52) U.S. Cl. ..... 81/478; 81/483
(58) Field of Search ..... 81/478, 480, 481, 81/483, 467, 473, 476

(56) References Cited

U.S. PATENT DOCUMENTS 4,870,879 A 10/1989 Shieh ..... 81/478
5,497,682 A * 3/1996 Hsu ..... 81/483
5,546,816 A * 8/1996 Jansson et al. ..... 81/478 X

* cited by examiner

*Primary Examiner*—D. S. Meislin

(57) ABSTRACT

An adjustable torque wrench includes a driving head having an arm received in a shank, and a follower and a spring received in the shank and guided to move along the shank. The follower may be moved to adjust the spring force against the arm. A handle is threaded onto the shank. A knob is secured to the follower. A lock may lock the follower to the shank and includes a control ferrule engaged on the knob and engaged onto the handle with such as a key or a teeth engagement in order to lock the knob to the handle and to prevent the knob from being rotated relative to the handle.

9 Claims, 3 Drawing Sheets

ADJUSTABLE TORQUE WRENCH HAVING A LOCK DEVICE

BACKGROUND OF THE INVENTION

1. Field of the Invention

The present invention relates to an adjustable torque wrench, and more particularly to an adjustable torque wrench having a lock device for lock the adjustable torque wrench and for preventing the adjustable torque wrench from being further adjusted or rotated after the adjustable torque wrench has been adjusted to the required driving torque.

2. Description of the Prior Art

U.S. Pat. No. 4,870,879 to Shieh discloses a typical adjustable torque wrench including a ratchet arm received in a shank, a spring and a sleeve engaged with the ratchet arm via a roller seat and a roller, and a knob coupled to the spring for adjusting the biasing force of the spring against the ratchet arm. However, the knob may not be locked and may be rotated or driven inadvertently during the operation of the adjustable torque wrench.

The present invention has arisen to mitigate and/or obviate the afore-described disadvantages of the conventional adjustable torque wrenches.

SUMMARY OF THE INVENTION

The primary objective of the present invention is to provide an adjustable torque wrench including a lock device for lock the adjustable torque wrench and for preventing the adjustable torque wrench from being further adjusted after the adjustable torque wrench has been adjusted to the required driving torque.

In accordance with one aspect of the invention, there is provided an adjustable torque wrench comprising a shank including a first end and a second end, a driving head including a ratchet arm received in the first end of the shank, a follower received in the second end of the shank, a spring engaged between the follower and the ratchet arm to apply a spring biasing force against the ratchet arm, means for moving the follower relative to the spring to adjust the spring biasing force of the spring against the ratchet arm, and means for locking the follower to the shank and to prevent the follower from moving relative to the shank.

The moving means includes a handle threaded onto the second end of the shank, and means for guiding the follower to slide relative to the shank and to prevent the follower from rotating relative to the shank, the shank is rotated relative to the handle by the follower in order to move and to adjust the follower relative to the shank when the follower and thus the shank are rotated relative to the handle.

The guiding means includes at least one longitudinal groove formed in the shank, and a pin engaged through the follower and slidably engaged in the longitudinal groove of the shank.

A device is further provided for adjusting the follower relative to the handle and includes a lock fastener threaded to the handle and engaged with the follower, the follower is moved and adjusted relative to the handle when the lock fastener is rotated and threaded relative to the handle.

A lock nut is further threaded onto the lock fastener and selectively engaged with the handle in order to lock the lock fastener to the handle.

A knob is further provided and secured to the follower in order to rotate the follower relative to the handle. The locking means includes a control ferrule engaged on the knob and selectively engaged onto the handle in order to lock the knob to the handle and to prevent the knob from being rotated relative to the handle.

The handle includes at least one longitudinal tooth formed thereon, the knob includes at least one longitudinal tooth formed thereon, the control ferrule includes at least one longitudinal tooth formed thereon and slidably engaged with the longitudinal teeth of the handle and the knob in order to prevent the knob from being rotated relative to the handle when the control ferrule is engaged with the handle.

A device is further provided for retaining the control ferrule to the knob and includes a spring-biased projection provided in the knob and engaged with the control ferrule to secure the control ferrule to the knob.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
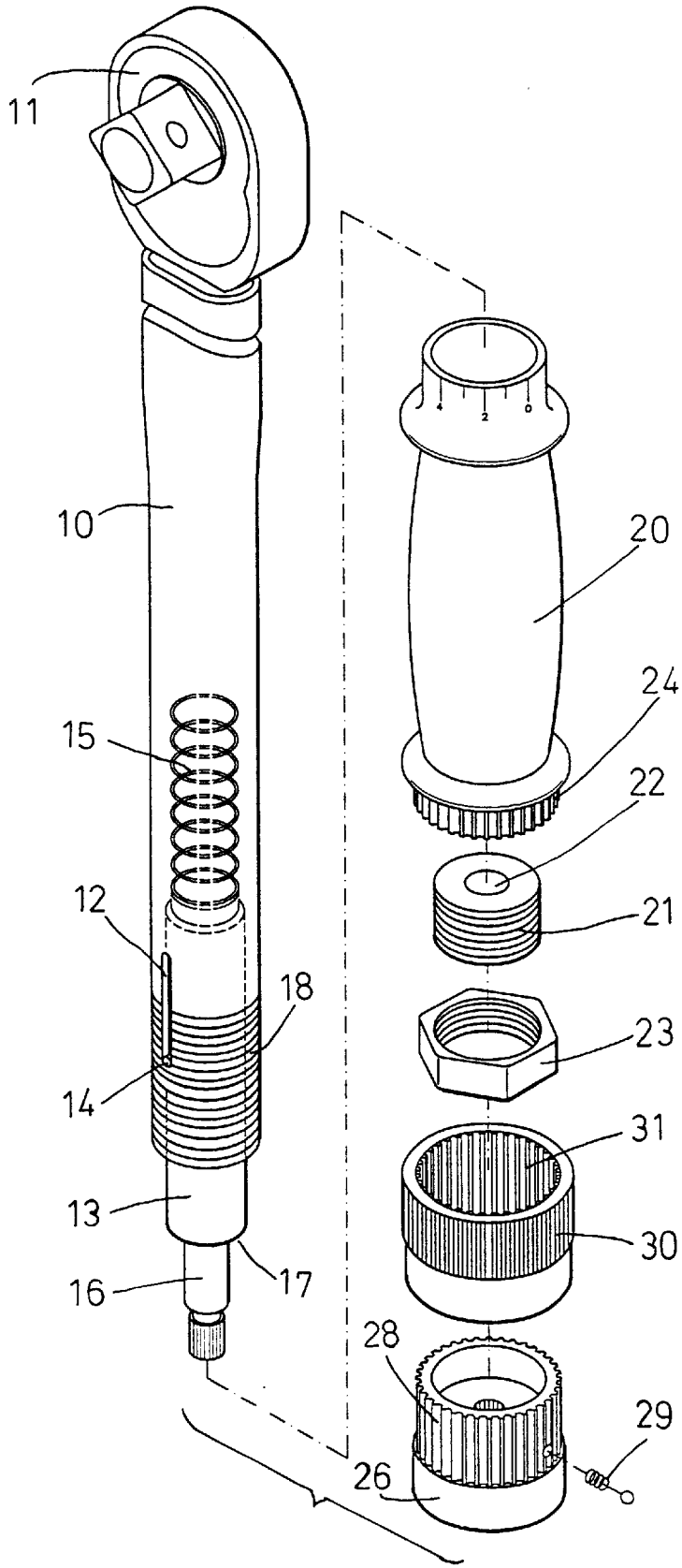
FIG. 1 is an exploded view of an adjustable torque wrench in accordance with the present invention.
Figure 2:
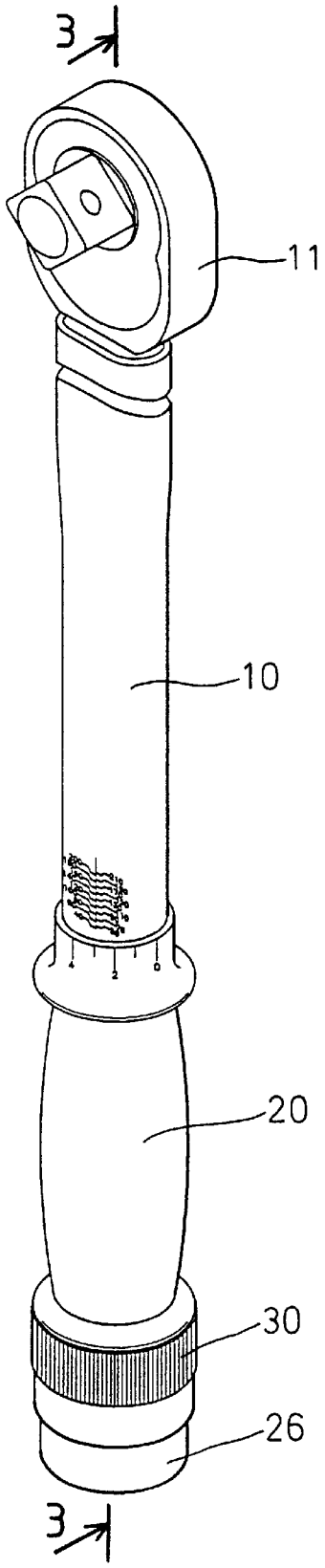
FIG. 2 is a perspective view of of the adjustable torque wrench.
Figure 3:
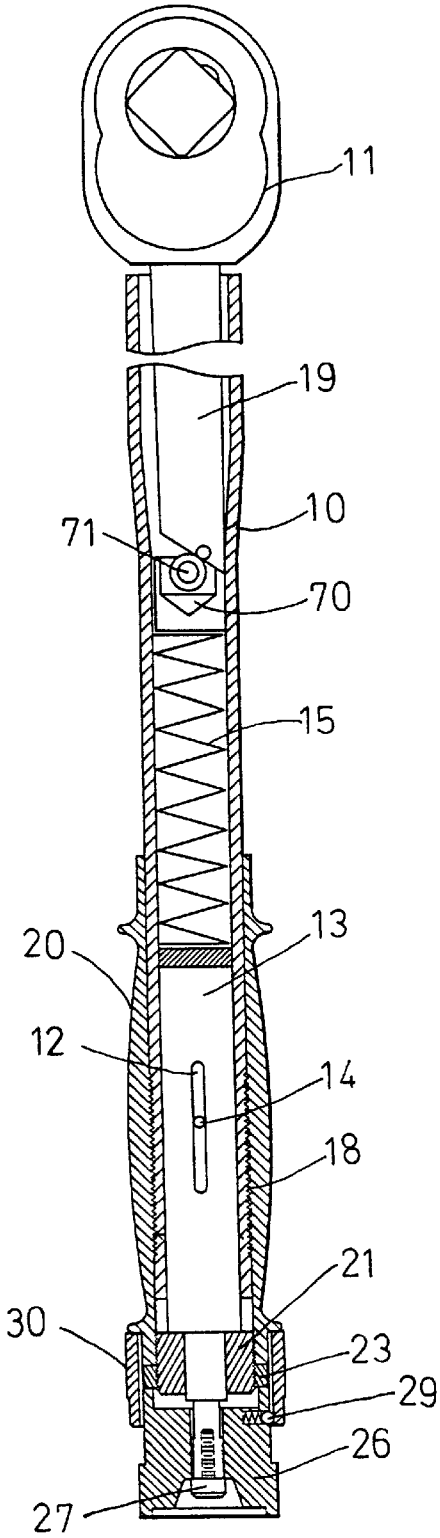
FIG. 3 is a cross sectional view taken along lines 3—3 of FIG. 2.

Referring to the drawings, and initially to FIGS. 1–3, an adjustable torque wrench in accordance with the present invention comprises a shank 10, a driving head 11 having a ratchet arm 19 extended therefrom and received in the shank 10, a roller seat 70 slidably received in the shank 10 and having a roller 71 for engaging with the ratchet arm 19, and a spring 15 received in the shank 10 and biased against the ratchet arm 19, and an adjusting device is provided for adjusting the biasing force against the ratchet arm 19 in order to adjust the driving torque of the torque wrench. The above-described configuration is not related to the present invention and has been disclosed in U.S. Pat. No. 4,870,879 to Shieh which is taken as a reference of the present invention.

The shank 10 includes one or more, particularly two longitudinal slots or grooves 12 formed in the end portion, such as the lower end portion thereof distal to the driving head 11. A follower 13 is slidably received in the shank 10 and engaged with the spring 15. A pin 14 is engaged through the follower 13 and slidably engaged in the grooves 12 of the shank 10 in order to guide the follower 13 to slide in the shank 10 only and to prevent the follower 13 from being rotated relative to the shank 10. The follower 13 includes an extension 16 having a diameter smaller than that of the follower 13 for forming a peripheral shoulder 17 between the follower 13 and the extension 16. The shank 10 includes an outer thread 18 formed in the outer portion of the lower end portion thereof.

A handle 20 includes an inner thread formed therein for threading with outer thread 18 of the shank 10, such that the handle 20 may be moved toward and away from the driving head 11 when the handle 20 is rotated or threaded relative to the shank 10. The handle 20 includes one end, particularly the lower end portion having one or more longitudinal ribs or teeth 24 formed on the outer peripheral portion thereof. A lock fastener 21 is threaded to the lower end of the handle 20 and includes an orifice 22 formed therein for receiving the extension 16 of the follower 13. The lock fastener 21 is engaged with the follower 13 for retaining the follower 13 within the shank 10 and may be rotated or threaded relative to the shank 10 in order to move the follower 13 relative to the spring 15 and in order to micro-adjust the spring biasing force of the spring 15 against the follower 13 and/or the ratchet arm 19. Another lock fastener, such as a lock nut 23 may further be provided and threaded onto the lock fastener 21 and engaged with the handle 20 so as to lock and to secure the lock fastener 21 to the handle 20.

A knob 26 is secured to the extension 16 with one or more fasteners 27 or with the keys or with the latches etc., and is thus secured to the follower 13, such that the follower 13 and thus the shank 10 may be rotated relative to the handle 20 by the knob 26. The knob 26 includes one or more longitudinal ribs or teeth 28 formed on the outer peripheral portion thereof and includes a spring-biased projection 29 provided therein. A control ferrule 30 is slidably engaged on and between the lower end of the handle 20 and the knob 26, and includes one or more longitudinal channels or ribs or teeth 31 formed on the inner peripheral portion thereof for engaging with the longitudinal ribs or teeth 24, 28 of the handle 20 and of the knob 26 and for guiding the control ferrule 30 to slide relative to the handle 20 and the knob 26 only and to prevent the control ferrule 30 from being rotated relative to the handle 20 and the knob 26.

Figure 4:
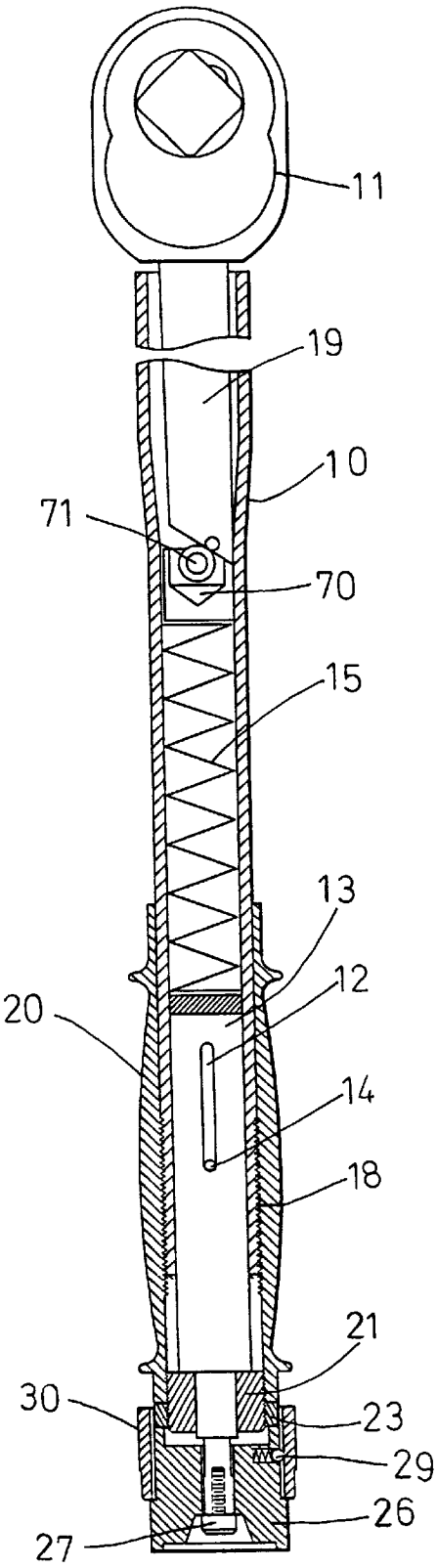
FIG. 4 is a cross sectional view similar to FIG. 3, illustrating the operation of the adjustable torque wrench.

As shown in FIG. 4, the control ferrule 30 may be moved onto the knob 26 and may be moved away from or disengaged from the handle 20 in order to disengage the channels or the ribs or the teeth 31 of the control ferrule 30 from the ribs or the teeth 24 of the handle 20. When the control ferrule 30 is disengaged from the handle 20, the knob 26 may be rotated relative to the handle 20 in order to rotate the follower 13 and thus the shank 10 relative to the handle 20, such that the shank 10 may be rotated relative to the handle 20 and may thus be moved toward and away from the knob 26 and guided by the sliding engagement of the pin 14 in the grooves 12 of the shank 10. The shank 10 may thus be slided or moved relative to the follower 13 in order to adjust the spring biasing force of the spring 15 against the ratchet arm 19.

As shown in FIG. 3, the control ferrule 30 may also be moved away from the knob 26 and moved onto the lower portion of the handle 20 in order to engage the channels or the ribs or the teeth 31 of the control ferrule 30 with the ribs or the teeth 24 of the handle 20. When the control ferrule 30 is fully engaged onto the teeth 24 of the handle 20, the control ferrule 30 is still engaged with the teeth 28 of the knob 26, such that the handle 20 and the knob 26 are locked together with the engagement between the teeth 24, 28 of the handle 20 and of the knob 26 and of the control ferrule 30. The knob 26 is thus locked to the handle 20 and may not be rotated relative to the handle 20. The spring-biased projection 29 of the knob 26 may engage with the control ferrule 30 to secure the control ferrule 30 to the knob 26, and to lock the control ferrule 30 relative to the knob 26 at least at the engagement position with the handle 20 (FIG. 3) and at the disengagement position with the handle 20 (FIG. 4).

Accordingly, the adjustable torque wrench includes a lock device for lock the adjustable torque wrench and for preventing the adjustable torque wrench from being further adjusted after the adjustable torque wrench has been adjusted to the required driving torque.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable torque wrench comprising:

a shank including a first end and a second end, a driving head including a ratchet arm received in said first end of said shank, a follower received in said second end of said shank, a spring engaged between said follower and said ratchet arm to apply a spring biasing force against said ratchet arm, means for moving said follower relative to said spring to adjust the spring biasing force of said spring against said ratchet arm, said moving means including a handle threaded onto said second end of said shank, and means for guiding said follower to slide relative to said shank and to prevent said follower from rotating relative to said shank, said shank being rotated relative to said handle by said follower in order to move and to adjust said follower relative to said shank when said follower and thus said shank are rotated relative to said handle, and means for locking said follower to said shank and to prevent said follower from moving relative to said shank, said guiding means including at least one longitudinal groove formed in said shank, and a pin engaged through said follower and slidably engaged in said at least one longitudinal groove of said shank.

2. The adjustable torque wrench according to claim 1 further comprising means for adjusting said follower relative to said handle.

3. The adjustable torque wrench according to claim 2, wherein said adjusting means includes a lock fastener threaded to said handle and engaged with said follower, said follower is moved and adjusted relative to said handle when said lock fastener is rotated and threaded relative to said handle.

4. The adjustable torque wrench according to claim 3 further comprising a lock nut threaded onto said lock fastener and selectively engaged with said handle in order to lock said lock fastener to said handle.

5. The adjustable torque wrench according to claim 1 further comprising a knob secured to said follower in order to rotate said follower relative to said handle.

6. An adjustable torque wrench comprising:

a shank including a first end and a second end, a driving head including a ratchet arm received in said first end of said shank, a follower received in said second end of said shank, a spring engaged between said follower and said ratchet arm to apply a spring biasing force against said ratchet arm, means for moving said follower relative to said spring to adjust the spring biasing force of said spring against said ratchet arm, said moving means including a handle threaded onto said second end of said shank, and means for guiding said follower to slide relative to said shank and to prevent said follower from rotating relative to said shank, said shank being rotated relative to said handle by said follower in order to move and to adjust said follower relative to said shank when said follower and thus said shank are rotated relative to said handle, and means for locking said follower to said shank and to prevent said follower from moving relative to said shank, and a knob secured to said follower in order to rotate said follower relative to said handle, said locking means including a control ferrule engaged on said knob and selectively engaged onto said handle in order to lock said knob to said handle and to prevent said knob from being rotated relative to said handle.

7. The adjustable torque wrench according to claim 6, wherein said handle includes at least one longitudinal tooth formed thereon, said knob includes at least one longitudinal tooth formed thereon, said control ferrule includes at least one longitudinal tooth formed thereon and slidably engaged with said at least one longitudinal teeth of said handle and said knob in order to prevent said knob from being rotated relative to said handle when said control ferrule is engaged with said handle.

8. The adjustable torque wrench according to claim 6 further comprising means for retaining said control ferrule to said knob.

9. The adjustable torque wrench according to claim 8, wherein said retaining means includes a spring-biased projection provided in said knob and engaged with said control ferrule to secure said control ferrule to said knob.

* * * * *